US010724824B1

(12) United States Patent
Lister et al.

(10) Patent No.: US 10,724,824 B1
(45) Date of Patent: Jul. 28, 2020

(54) GRIP PLUG

(71) Applicant: Umbrella Corporation Weapons Research Group, Virginia Beach, VA (US)

(72) Inventors: Stephen D. Lister, Virginia Beach, VA (US); Eric C. Burt, Alexandria, VA (US)

(73) Assignee: Umbrella Corporation Weapons Research Group, Virginia Beach, VA (US)

( * ) Notice: Subject to any disclaimer, the term of this patent is extended or adjusted under 35 U.S.C. 154(b) by 0 days.

(21) Appl. No.: 16/430,132

(22) Filed: Jun. 3, 2019

Related U.S. Application Data

(60) Provisional application No. 62/679,665, filed on Jun. 1, 2018.

(51) Int. Cl.
*F41C 23/10* (2006.01)
*F41C 23/12* (2006.01)

(52) U.S. Cl.
CPC ..... *F41C 23/10* (2013.01); *F41C 23/12* (2013.01)

(58) Field of Classification Search
CPC ..... F41C 23/10; F41C 23/12; F41C 23/22; F41C 23/16; F41C 27/00
See application file for complete search history.

(56) References Cited

U.S. PATENT DOCUMENTS

D273,316 S 4/1984 Lambert
4,697,368 A * 10/1987 Williams ..... F41A 9/85 42/71.02
5,159,136 A * 10/1992 Marsh ..... F41C 23/22 42/71.01
6,389,729 B2 * 5/2002 Rauch ..... F41C 23/10 42/71.01
6,536,152 B1 * 3/2003 Wisz ..... F41C 23/22 42/1.02
6,874,266 B1 * 4/2005 Kong ..... F41C 23/22 42/7
6,981,344 B2 1/2006 Cahill et al.
D600,309 S 9/2009 Fitzpatrick et al.
D639,889 S 6/2011 Troy, Jr.
8,151,504 B1 4/2012 Aiston
D667,916 S 9/2012 Mayberry
D692,517 S 10/2013 Faifer
(Continued)

OTHER PUBLICATIONS https://www.magpul.com/firearms-accessories/grips/ar15-m4-m16-sr25-m110-ar10.

*Primary Examiner* — Gabriel J. Klein
(74) *Attorney, Agent, or Firm* — Shaddock Law Group, PC

(57) ABSTRACT

A grip and grip plug, the grip having a grip cavity extending from an open grip cavity bottom end; a tab aperture and a lock protrusion aperture formed proximate the grip cavity bottom end; the grip plug having a skirt extending from at least a portion of the plug body; a tether portion and a lock protrusion extending from the skirt, wherein the tether portion is positionable through at least a portion of the lock protrusion aperture, and wherein the lock protrusion extends beyond at least a portion of the lock protrusion aperture; and a tab extending from the skirt, proximate a first end portion of the grip plug body, wherein the tab is removably engageable with at least a portion of the tab aperture, such that the grip plug is positionable within at least a portion of the open grip cavity bottom end.

20 Claims, 11 Drawing Sheets

(56) References Cited

U.S. PATENT DOCUMENTS

| | | | | |
|---|---|---|---|---|
| D705,887 | S | 5/2014 | Fitzpatrick et al. | |
| 8,720,098 | B2 | 5/2014 | Burress, Jr. | |
| D710,966 | S | 8/2014 | Barfoot et al. | |
| D722,125 | S | 2/2015 | Zayatz et al. | |
| D724,688 | S | 3/2015 | Hirt et al. | |
| D732,135 | S | 6/2015 | Webber | |
| D732,136 | S | 6/2015 | Webber | |
| D735,832 | S | 8/2015 | Fitzpatrick et al. | |
| D740,910 | S | 10/2015 | Hines | |
| D742,986 | S | 11/2015 | Ward, Jr. et al. | |
| D763,393 | S | 8/2016 | Freed | |
| D769,399 | S | 10/2016 | Lam et al. | |
| D769,398 | S | 12/2016 | Lam et al. | |
| D774,156 | S | 12/2016 | Esch et al. | |
| D792,935 | S | 7/2017 | Ward, Jr. et al. | |
| D812,181 | S | 3/2018 | Hartley | |
| D812,708 | S | 3/2018 | Hartley | |
| D821,529 | S | 6/2018 | Cheng et al. | |
| D600,310 | S | 9/2019 | Fitzpatrick et al. | |
| 2003/0136044 | A1* | 7/2003 | Williams | F41A 29/00 42/95 |
| 2004/0111946 | A1* | 6/2004 | Wikle | F41C 23/10 42/71.02 |
| 2011/0283581 | A1 | 11/2011 | Freed | |
| 2013/0125442 | A1 | 5/2013 | Burress, Jr. | |
| 2013/0139426 | A1* | 6/2013 | Baxley | F41C 23/10 42/71.02 |
| 2013/0305580 | A1 | 11/2013 | Burress, Jr. | |
| 2017/0108301 | A1 | 4/2017 | Murphy, II et al. | |
| 2019/0107348 | A1* | 4/2019 | Harrigan | F41A 3/66 |

* cited by examiner

GRIP PLUG

CROSS-REFERENCE TO RELATED APPLICATIONS

This patent application claims the benefit of U.S. Patent Application Ser. No. 62/679,665, filed Jun. 1, 2018, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE DISCLOSURE

1. Field of the Disclosure

The present disclosure relates generally to the field of firearm components. More specifically, the present disclosure relates to a grip plug to be used with a firearm grip.

2. Description of Related Art

A number of firearms utilize a pistol style grip. One such firearm is the M-16, M-4, and AR-15 family of firearms. The typical grip or "pistol grip" extends from the firearm in a fashion that more closely resembles a pistol grip than a traditional rifle stock grip.

Pistol grips typically include a lower receiver recess formed in a top portion of the grip, which allows a portion of a lower receiver to be received within the lower receiver recess, so that the grip can be attached or coupled to the lower receiver. The grip typically includes a grip screw aperture, which allows a grip screw to pass therethrough to further secure the grip to the lower receiver.

A safety selector spring recess is typically formed in a portion of the grip to secure a safety selector spring at least partially therein, thereby allowing the safety selector spring to interact with a detent and safety selector.

Typically, the grip includes an interior cavity or opening, which allows access to the interior of the grip for securing the grip screw within the grip screw aperture and securing the grip to the lower receiver. Some grips include a cover that is hingedly attached or coupled to the bottom portion of the grip to cover the opening of the grip cavity and optionally provide storage within the grip cavity. Other grip covers are slidably secured to the bottom end of the grip using a series of interacting recesses and protrusions to secure the cover to the grip.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE DISCLOSURE

However, the typical grip covers have various shortcomings. For example, hingedly attached doors require additional components to secure or fasten the doors to the grip. Furthermore, rigid attachment to the grip leaves the door susceptible to being broken off the grip. Covers that are not attached or secured to the grip can easily be lost or inadvertently misplaced from the grip.

Thus, there exists a need for a grip plug that is attached or coupled to a grip in a manner that allows the grip cavity to be closed off or sealed, without being susceptible to being broken or inadvertently removed or misplaced.

In various exemplary, non-limiting embodiments, the grip plug of the present disclosure comprises a grip plug body extending from a first end portion to a second end portion; a skirt extending from at least a portion of the grip plug body; a pull tab extending from a portion of the plug body; a tether portion extending from the skirt, proximate the second end portion of the grip plug body, wherein a lock protrusion extends from the tether portion; and a tab extending from the skirt, proximate the first end portion of the grip plug body.

In certain exemplary embodiments, the grip plug body is a substantially oval shape.

In certain exemplary embodiments, two or more flex recesses are formed through at least a portion of the skirt, wherein each flex recess is formed proximate the tab.

In certain exemplary embodiments, the lock protrusion is a T-shaped lock protrusion.

In certain exemplary embodiments, the grip plug is formed of a substantially resilient material.

In certain exemplary embodiments, each of the grip plug body, the skirt, the tab, the tether portion, the lock protrusion, and the pull tab are integrally formed as a single component.

In various exemplary, non-limiting embodiments, the grip and grip plug of the present disclosure comprises a grip body having a grip cavity extending from an open grip cavity bottom end to a grip cavity top wall portion; a tab aperture formed proximate the grip cavity bottom end; a lock protrusion aperture formed proximate the grip cavity bottom end; the grip plug, comprising: a grip plug body extending from a first end portion to a second end portion; a skirt extending from at least a portion of the grip plug body; a pull tab extending from a portion of the plug body; a tether portion extending from the skirt, proximate the second end portion of the grip plug body, wherein a lock protrusion extends from the tether portion, wherein the tether portion is positionable through at least a portion of the lock protrusion aperture, and wherein the lock protrusion extends beyond at least a portion of the lock protrusion aperture; and a tab extending from the skirt, proximate the first end portion of the grip plug body, wherein the tab is removably engageable with at least a portion of the tab aperture, such that when the tab is engaged within at least a portion of the tab aperture, the grip plug is positioned within at least a portion of the open grip cavity bottom end.

In certain exemplary embodiments, when the grip plug is positioned within at least a portion of the open grip cavity bottom end, frictional engagement between at least a portion of the grip plug and interior side walls forming the grip cavity hermetically seal the grip cavity.

Accordingly, the present disclosure separately and optionally provides a grip plug for a firearm grip.

The present disclosure separately and optionally provides a grip plug that is tether portioned to a firearm grip.

The present disclosure separately and optionally provides a grip plug that may be utilized to cover an open end of a cavity formed within a firearm grip.

The present disclosure separately and optionally provides a grip plug that may be frictionally maintained within at least a portion of a cavity formed within a firearm grip.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary and may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE DISCLOSURE

Figure 1:
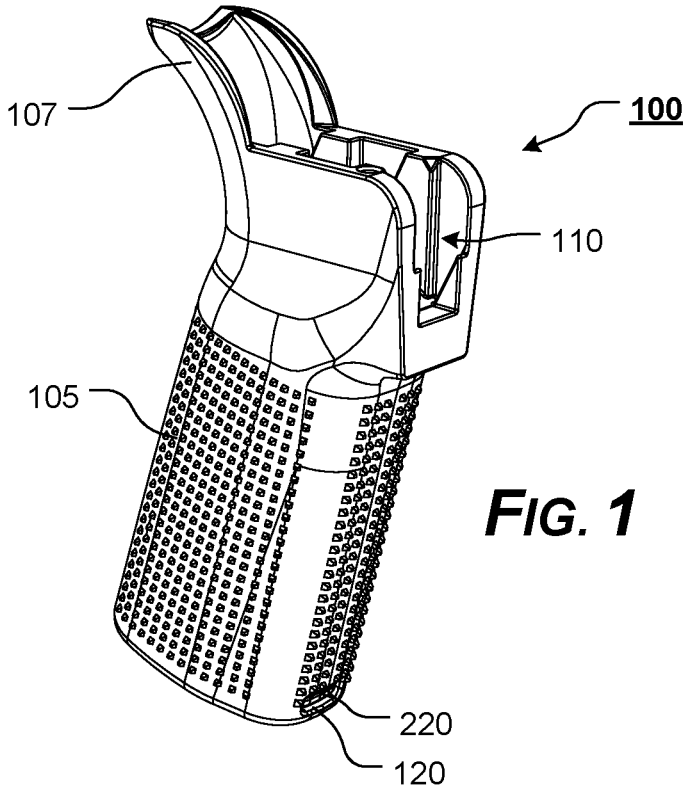
FIG. 1 illustrates an upper, right, front perspective view of a firearm grip with a grip plug, according to the present disclosure.
Figure 2:
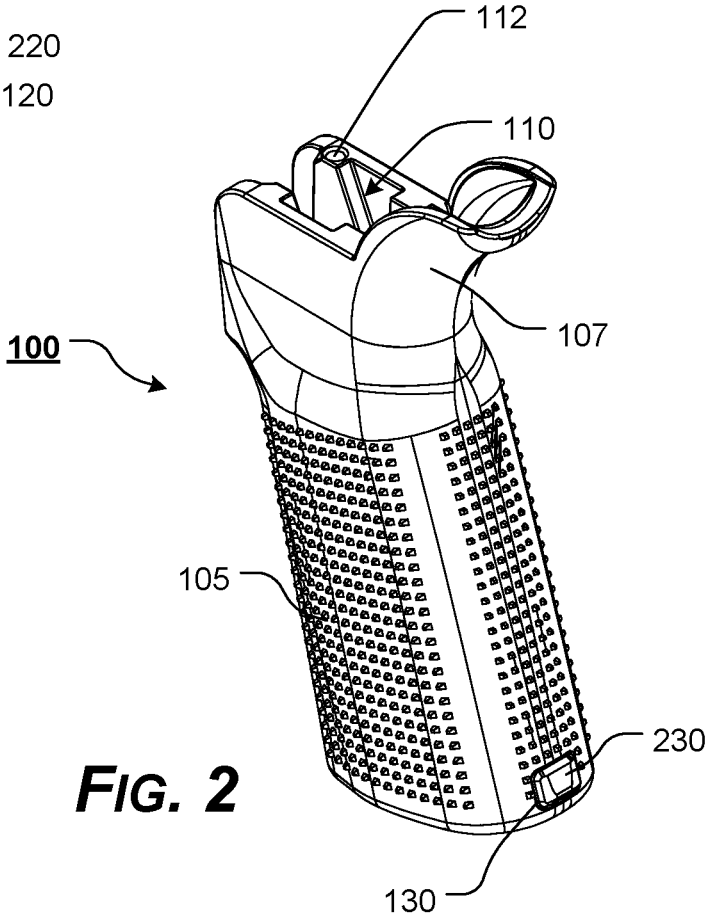
FIG. 2 illustrates an upper, left, rear perspective view of a firearm grip with a grip plug, according to the present disclosure.
Figure 3:
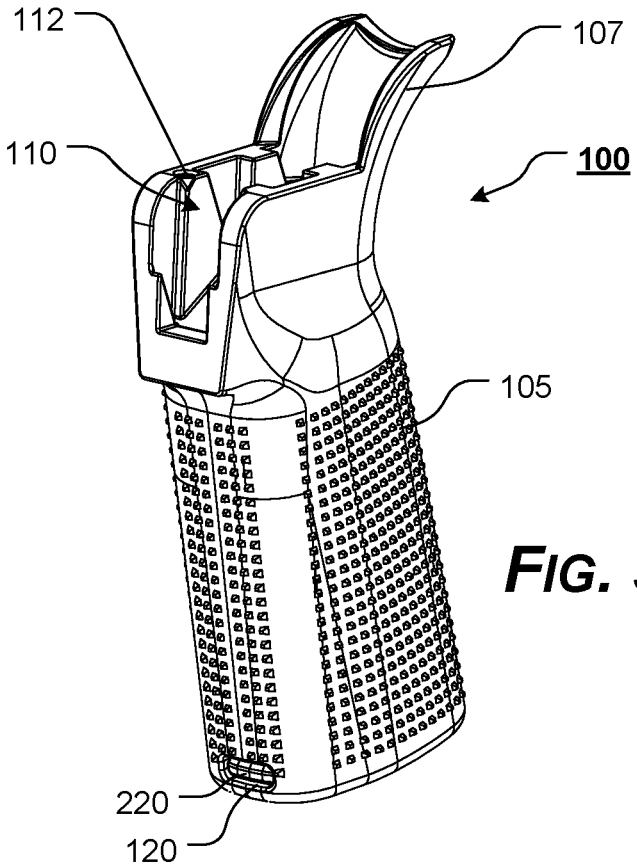
FIG. 3 illustrates an upper, left, front perspective view of a firearm grip with a grip plug, according to the present disclosure.
Figure 4:
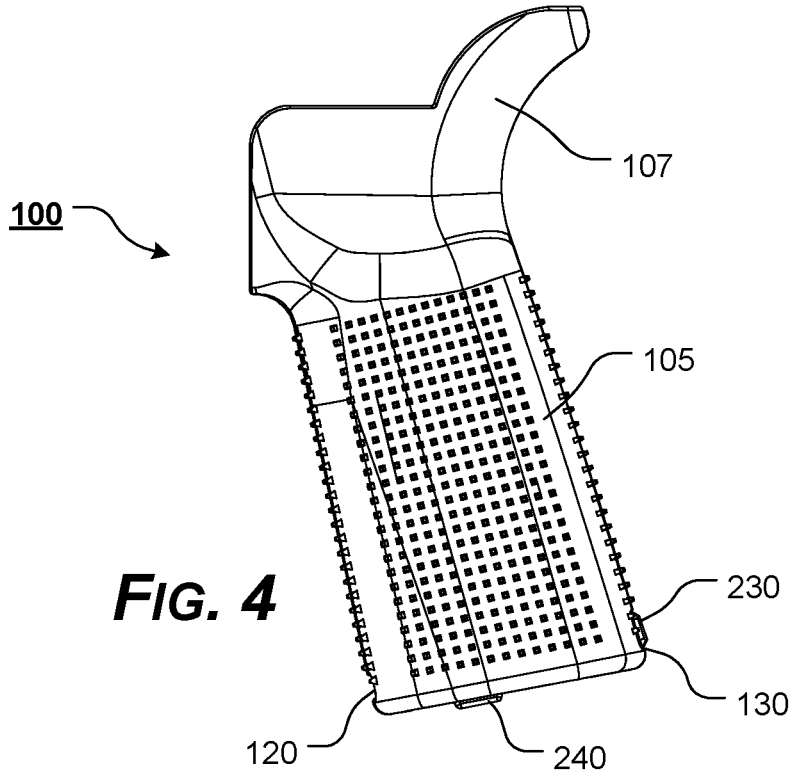
FIG. 4 illustrates a left side view of a firearm grip with a grip plug, according to the present disclosure, it being appreciated that the right side view of the firearm grip with the grip plug is a substantially mirror image of the left side view of the firearm grip with the grip and plug.
Figure 5:
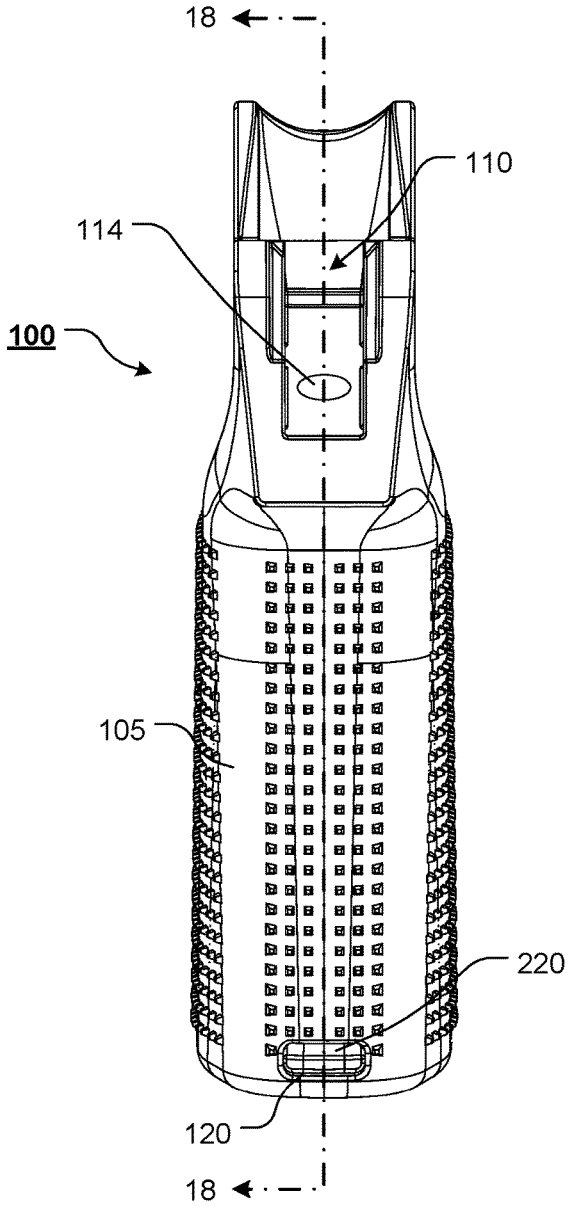
FIG. 5 illustrates a front view of a firearm grip with a grip plug, according to the present disclosure.
Figure 6:
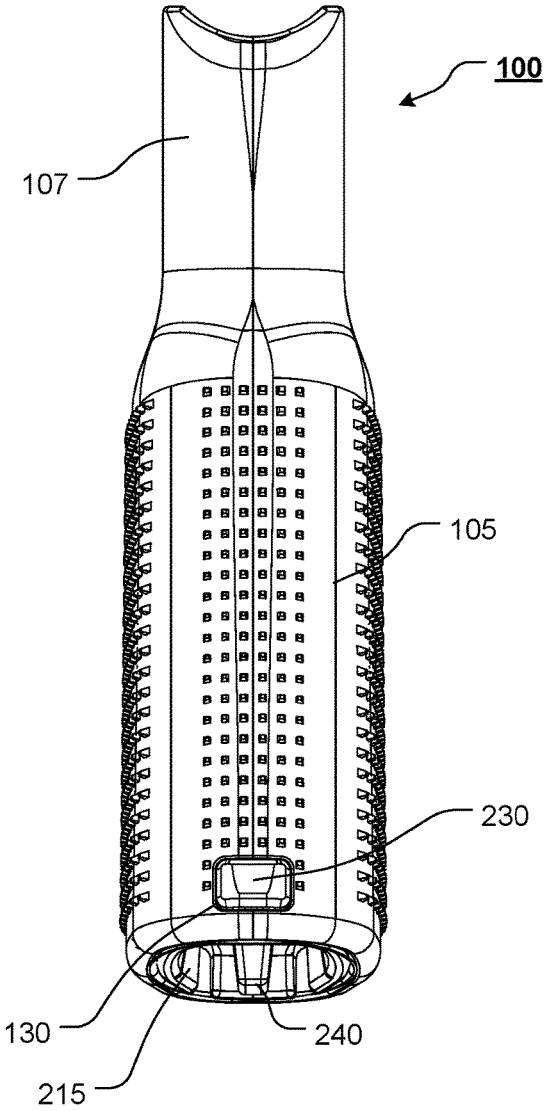
FIG. 6 illustrates a rear view of a firearm grip with a grip plug, according to the present disclosure.
Figure 7:
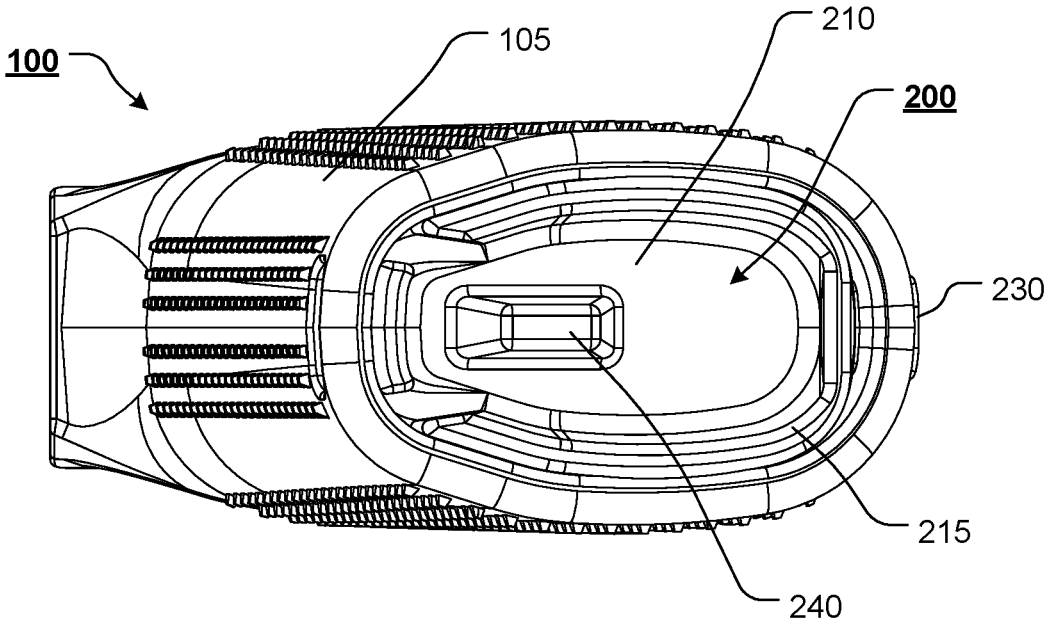
FIG. 7 illustrates a bottom view of a firearm grip with a grip plug, according to the present disclosure.
Figure 8:
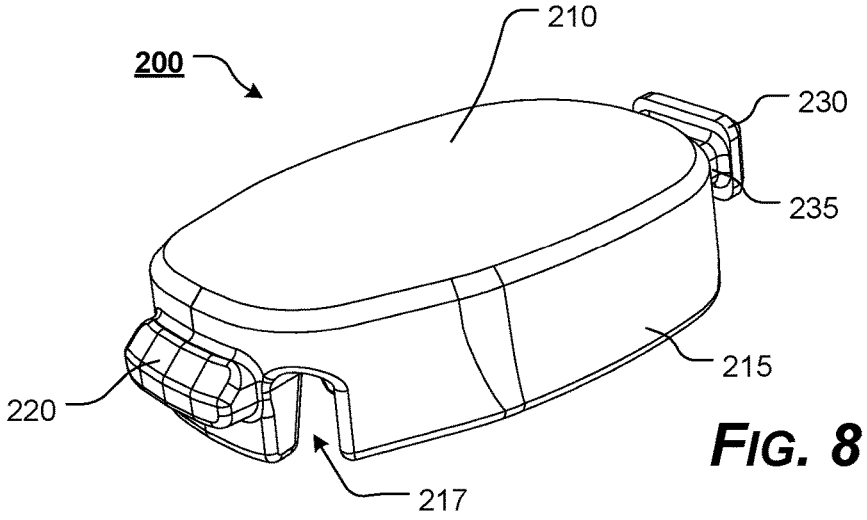
FIG. 8 illustrates an upper, left, front perspective view of a firearm grip with a grip plug, according to the present disclosure.
Figure 9:
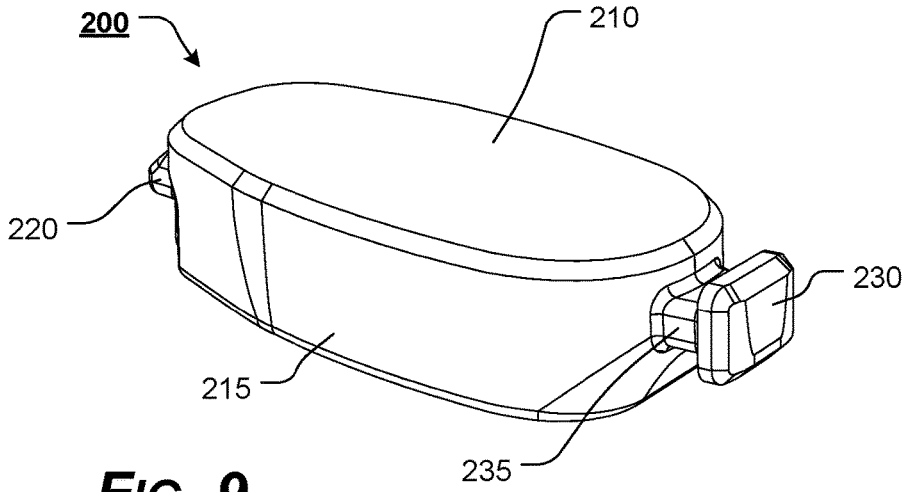
FIG. 9 illustrates an upper, left, rear perspective view of a firearm grip with a grip plug, according to the present disclosure.
Figure 10:
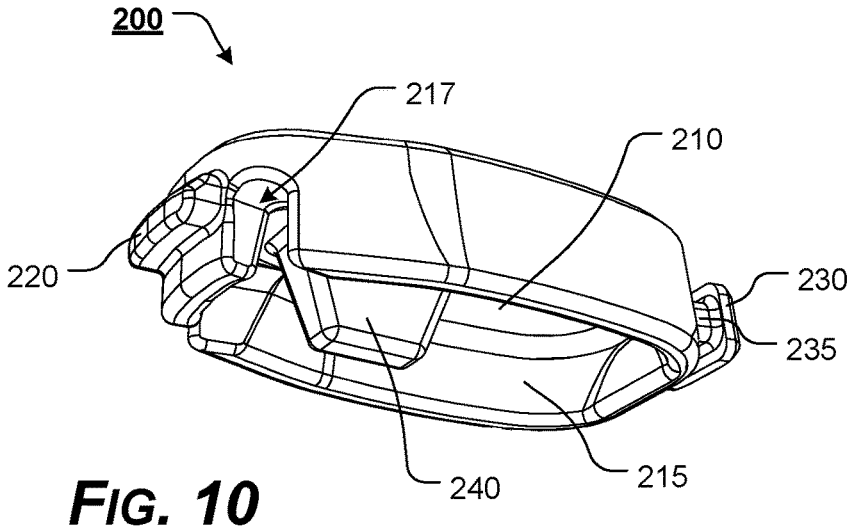
FIG. 10 illustrates a lower, left, front perspective view of a firearm grip with a grip plug, according to the present disclosure.
Figure 11:
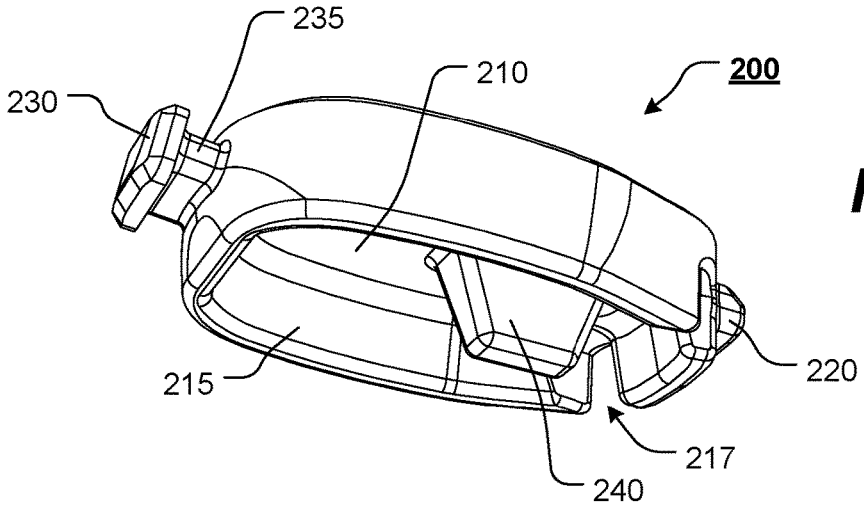
FIG. 11 illustrates a lower, right, rear perspective view of a firearm grip with a grip plug, according to the present disclosure.
Figure 12:
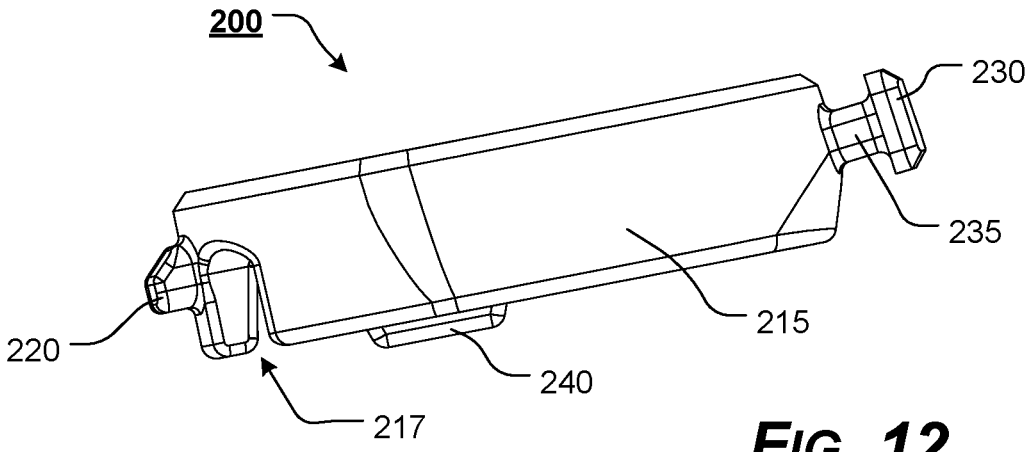
FIG. 12 illustrates a left side view of a firearm grip with a grip plug, according to the present disclosure.
Figure 13:
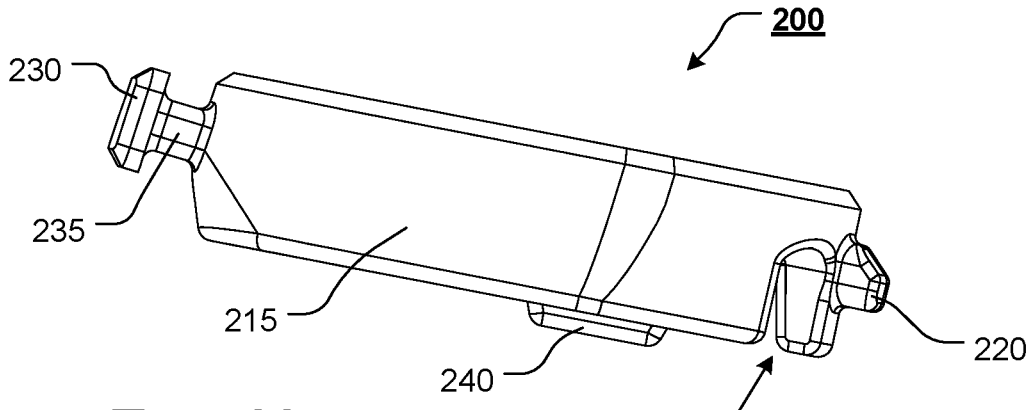
FIG. 13 illustrates a right side view of a firearm grip with a grip plug, according to the present disclosure.
Figure 14:
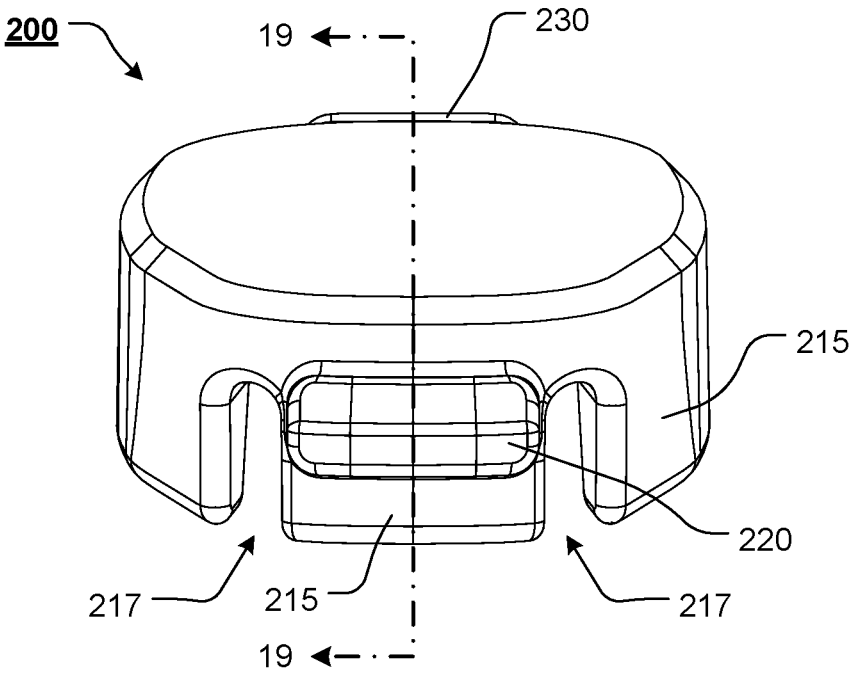
FIG. 14 illustrates a front view of a firearm grip with a grip plug, according to the present disclosure.
Figure 15:
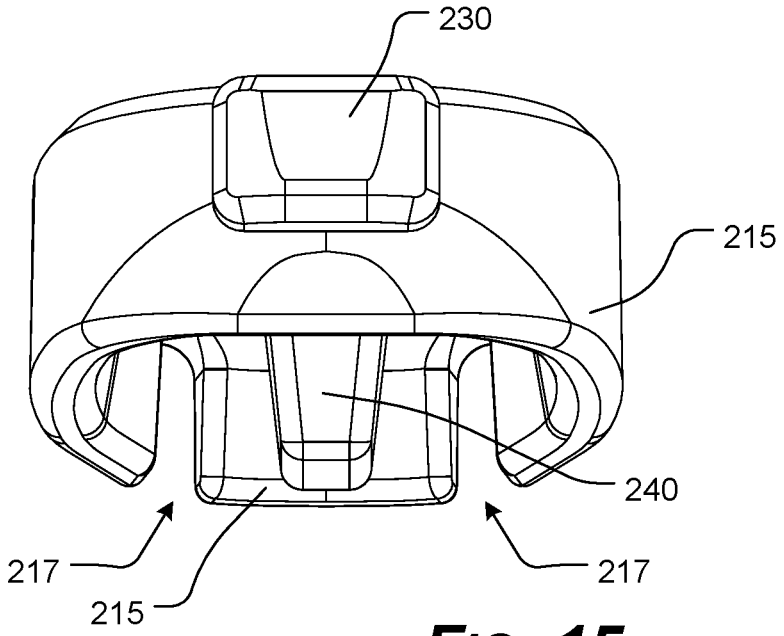
FIG. 15 illustrates a rear view of a firearm grip with a grip plug, according to the present disclosure.
Figure 16:
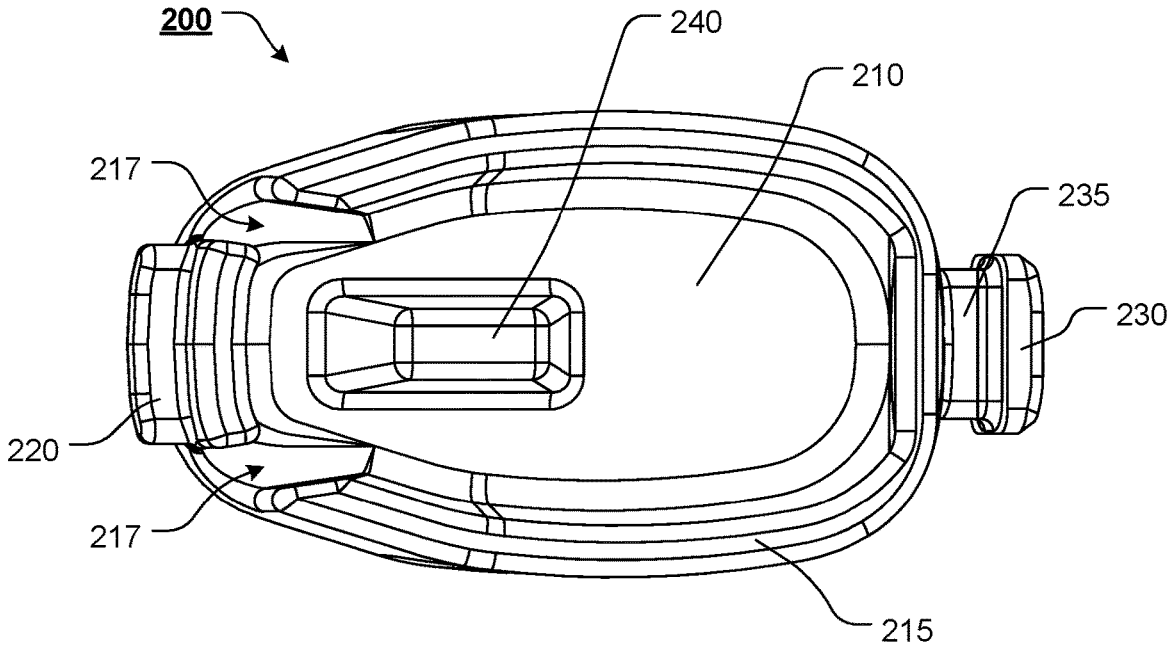
FIG. 16 illustrates a bottom view of a firearm grip with a grip plug, according to the present disclosure.
Figure 17:
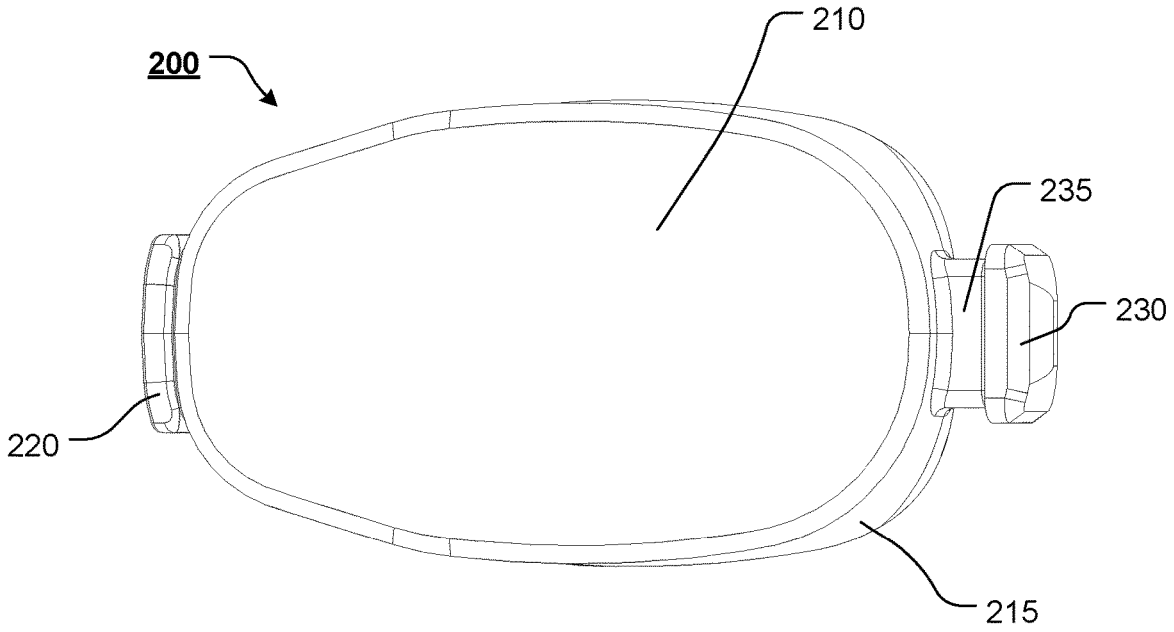
FIG. 17 illustrates a top view of a firearm grip with a grip plug, according to the present disclosure.
Figure 18:
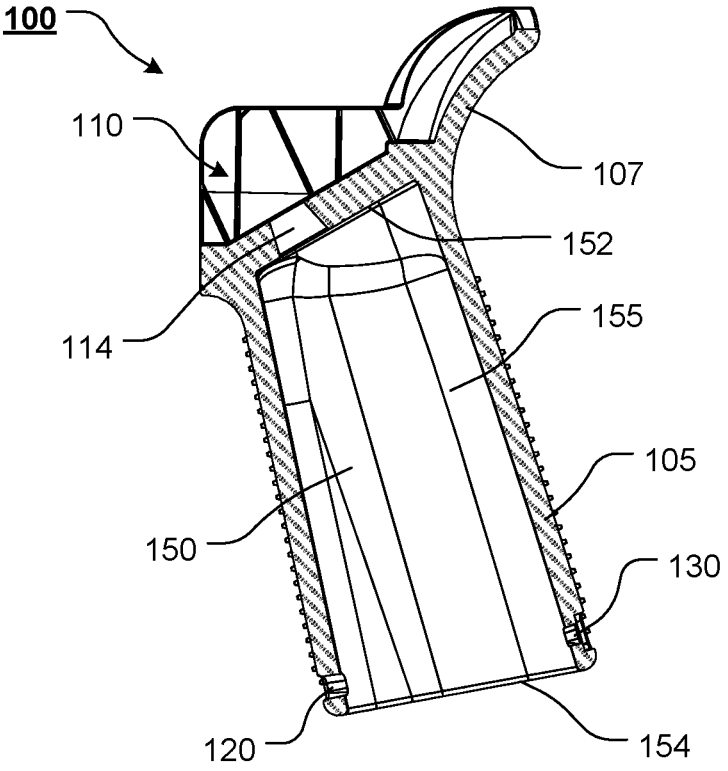
FIG. 18 illustrates a left, side, cross-sectional view, taken along line 18-18 of the grip of FIG. 5, according to the present disclosure.
Figure 19:
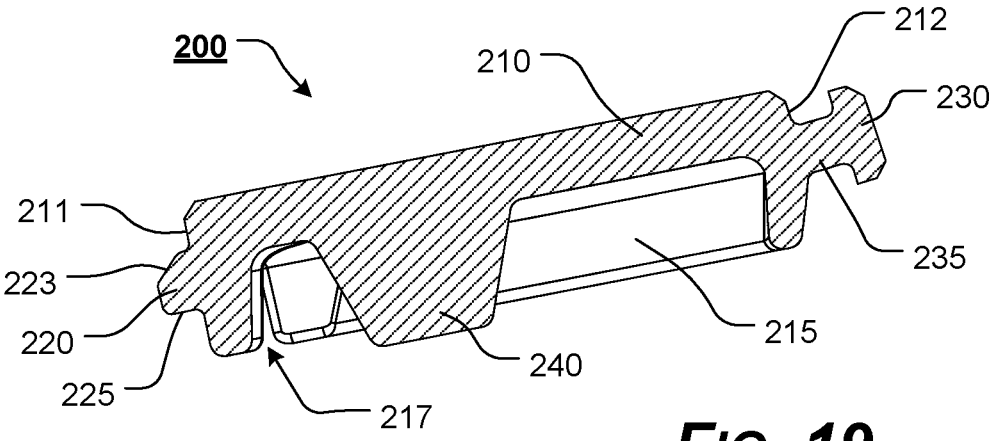
FIG. 19 illustrates a left, side, cross-sectional view, taken along line 19-19 of the grip plug of FIG. 14, according to the present disclosure.

For simplicity and clarification, the design factors and operating principles of the grip and grip plug of the present disclosure are explained with reference to various exemplary embodiments of a grip and a grip plug according to the present disclosure. The basic explanation of the design factors and operating principles of the grip and grip plug is applicable for the understanding, design, and operation of the grip and grip plug of the present disclosure. It should be appreciated that the grip and grip plug can be adapted to many applications where a grip and grip plug can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "grip", "grip plug", and "firearm" are used for basic explanation and understanding of the operation of the systems, methods, and apparatuses of the present disclosure. Therefore, the terms "grip", "grip plug", and "firearm" are not to be construed as limiting the systems, methods, and apparatuses of the present disclosure.

For simplicity and clarification, the grip plug of the present disclosure will be described as being used in conjunction with a firearm grip, such as a rifle pistol grip. However, it should be appreciated that these are merely exemplary embodiments of the grip plug and are not to be construed as limiting the present disclosure. Thus, the grip and grip plug of the present disclosure may be utilized in conjunction with any firearm or non-firearm grip.

Turning now to the drawing FIGS., FIGS. 1-21 illustrate certain elements and/or aspects of a grip 100 and/or grip plug 200, according to the present disclosure.

In certain illustrative, non-limiting embodiment(s) of the present disclosure, the grip 100 comprises a grip body 105 that includes an optional lower receiver recess 110 formed in a top portion of the grip body 105, which allows a portion of a lower receiver of a firearm to be received within the lower receiver recess 110, so that the grip 100 can be attached or coupled to the lower receiver.

An optional safety selector spring recess 112 is formed in a top portion of the grip body 105 to secure a safety selector spring at least partially therein, thereby allowing the safety selector spring to interact with a detent and safety selector.

It should be appreciated that the size and shape of the upper portion of the grip body 105, the lower receiver recess 110, and the safety selector spring recess 112, if included, is a design choice based upon the firearm or other device with which the grip 100 is intended to be utilized.

The grip body 105 may optionally extend to include a backstrap 107 or backstrap portion. It should be appreciated that the backstrap 107 or backstrap portion is optional.

Various portions of the grip body 105 may include texturing or various textured portions. The amount, shape, and/or type of texturing or various textured portions is a design choice based upon the desired tactile feel or appearance of the grip 100.

In various exemplary embodiments, the grip body 105 is substantially rigid and is formed of a polymeric material such as a polymeric composite. Alternate materials of construction of the grip body 105 may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

Thus, it should be understood that the material or materials used to form the grip body 105 are generally substantially rigid, but are a design choice based on the desired appearance and/or functionality of the grip 100.

In illustrative, non-limiting embodiment(s) of the present disclosure, as illustrated most clearly in FIGS. 1-7, 18, and 20-21, the grip body 105 defines a grip cavity 150. In various exemplary embodiments, one or more interior side wall portions 155 and a grip cavity top wall portion 152 define the grip cavity 150. The grip cavity 150 extends from a substantially open grip cavity bottom end 154 to a grip cavity top wall portion 152. In these exemplary embodiments, the one or more interior side wall portions 155 also define the grip cavity 150 of the grip body 105.

In various exemplary, nonlimiting embodiments, the grip cavity 150 is formed from a first side wall portion, a second side wall portion, a front wall portion, and a rear wall portion.

However, it should be appreciated that the grip cavity 150 may be formed such that one or more interior side wall portions define the grip cavity 150. In these exemplary embodiments, the grip cavity 150 may be formed from any number or combination of side walls, side, front, rear, and/or top walls, or interior side wall portions, including, for example, a single, continuous wall portion or multiple coupled or joined interior side wall and top wall portions. Thus, the grip cavity 150 may be formed by any size or shape grip cavity 150, partial grip cavity, space, or recess.

In various exemplary, nonlimiting embodiments, the grip cavity 150 includes a grip screw aperture 114 formed in the grip cavity top wall portion 152, which allows a at least a portion of the grip screw to be positioned therethrough such that the grip screw can be used to further secure the grip 100 to the lower receiver. It should be appreciated that the grip screw aperture 114 is optional, depending upon how the grip 100 is to be attached or coupled to a device, such as, for example, a lower receiver of a firearm.

A tab aperture 120 is formed proximate the grip cavity bottom end 154. In various exemplary embodiments, the tab aperture 120 is formed proximate the front of the grip body 105. The tab aperture 120 comprises an aperture or recess formed through at least a portion of the grip body 105, extending from the interior side wall portion 155, toward or through the grip body 105. In various exemplary embodiments, as illustrated, the tab aperture 120 may comprise a substantially rectangular aperture formed through the grip body 105. Alternatively, the tab aperture 120 may comprise any overall size or shape, which is capable of interacting with the tab 220 extending from the grip plug 200, so as to aid in securing the grip plug 200 in a closed position, by engagement between the tab aperture 120 and the tab 220.

A lock protrusion aperture 130 is formed proximate the grip cavity bottom end 154. In various exemplary embodiments, the lock protrusion aperture 130 is formed proximate the rear of the grip body 105. The lock protrusion aperture 130 comprises an aperture or recess formed through at least a portion of the grip body 105, extending from the interior side wall portion 155, toward or through the grip body 105. In various exemplary embodiments, as illustrated, the lock protrusion aperture 130 may comprise a substantially rectangular aperture formed through the grip body 105.

In certain exemplary embodiments, as illustrated, the lock protrusion aperture 130 may include a recessed portion, thus providing an enlarged, recessed portion extending to a shoulder and then to the lock protrusion aperture 130.

Alternatively, the lock protrusion aperture 130 may comprise any overall size or shape, which is capable of interacting with the lock protrusion 230 and/or tether portion 235 of the grip plug 200, so as to aid in securing the grip 100 and plug to the grip body 105 by engagement between the lock protrusion aperture 130 and the tether portion 235 and/or lock protrusion 230, such that the tether portion 235 is maintained at least partially within the lock protrusion aperture 130 while the lock protrusion 230 is maintained outside the lock protrusion aperture 130.

In various exemplary, non-limiting embodiments, the grip plug 200 of the present disclosure, as illustrated most clearly in FIGS. 8-17 and 19 comprises a grip plug body 210 extending from a first end portion 211 to a second end portion 212. In various exemplary, nonlimiting embodiments, a skirt 215 extends from at least a portion of the grip plug body 210.

As illustrated, the grip plug body 210 may optionally have a substantially ovular shape, when viewed from the top or bottom. It should be appreciated that this is merely exemplary and not limiting the shape of the grip plug body 210. The overall size and/or shape of the grip plug body 210 is dictated by the size and/or shape of the open grip cavity bottom end 154 and the grip plug body 210 is formed so as to at least partially seal the open grip cavity bottom end 154 of the grip plug body 210, when in a closed position, as illustrated in FIGS. 1-7 and 20.

The skirt 215 extends from at least a portion of the grip plug body 210. Generally, the skirt 215 extends downward from a portion of the grip plug body 210. In certain exemplary embodiments, a plane created by an outer wall surface of the skirt 215 is substantially perpendicular to a top, planar surface of the grip plug body 210. Alternatively, a plane created by the outer wall surface of the skirt 215 is formed so as to be at a substantially acute or substantially obtuse angle relative to a top, planar surface of the grip plug body 210. In this manner, the skirt 215 can extend from a portion of the grip plug body 210 so as to flare outward, remain substantially consistent with, or flare inward as compared to the outer perimeter of the grip plug body 210.

Figure 20:
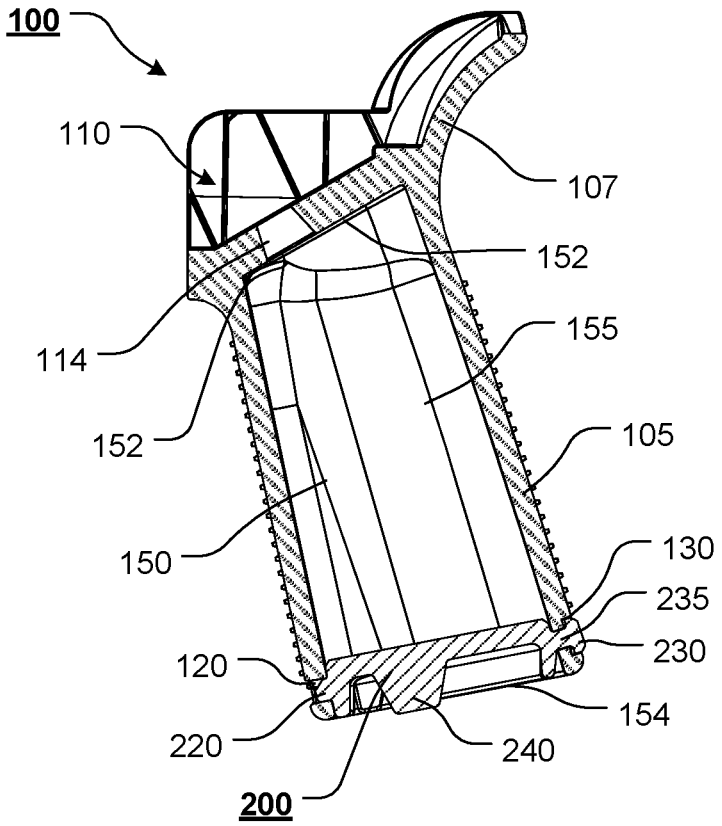
FIG. 20 illustrates a left, side, cross-sectional view, a firearm grip with a tether portioned and closed grip plug, according to the present disclosure.
Figure 21:
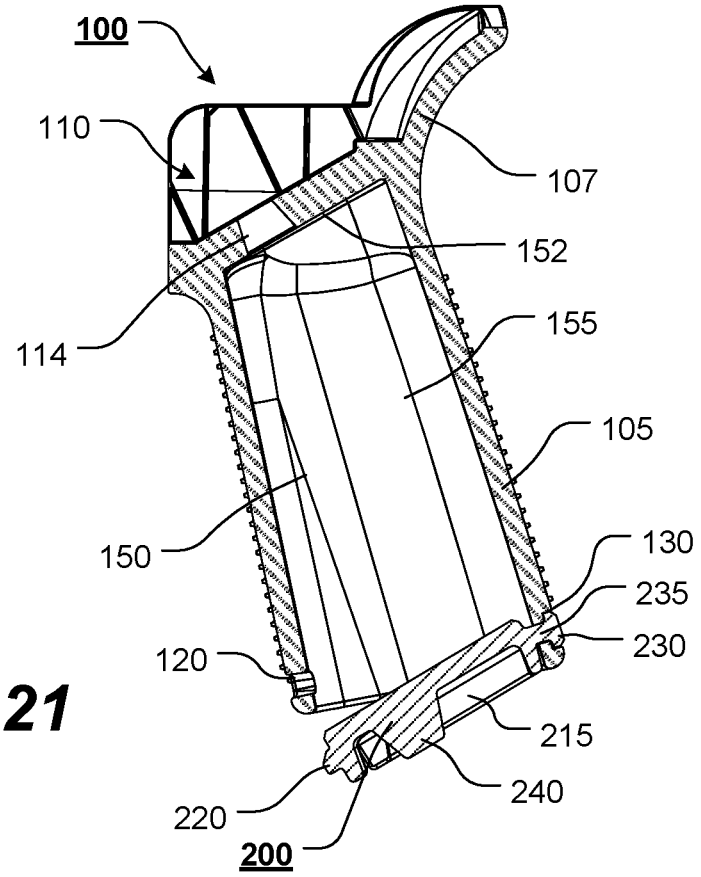
FIG. 21 illustrates a left, side, cross-sectional view, a firearm grip with a tether portioned and at least partially opened grip plug, according to the present disclosure.

In various exemplary, nonlimiting embodiments, the grip plug 200 may comprise an at least partially resilient material such as silicon or vulcanized rubber. In this manner, the grip plug 200 may not only provide a degree of resilient flexibility for repeatably moving the grip plug 200 between an open position (as illustrated in FIG. 21) and a closed position (as illustrated in FIG. 20), but also provide releasable frictional engagement between an exterior or perimeter surface portion of the grip plug 200 and at least a portion of the interior side wall portions 155.

The skirt 215, if included, provides additional area for potential frictional engagement between the interior side wall portions 155 and the exterior portion of the grip plug 200. In certain exemplary embodiments, when the grip plug 200 is positioned within at least a portion of the open grip cavity bottom end 154, frictional engagement between at least a portion of the grip plug 200 and/or the skirt 215 and the interior side walls forming the grip cavity 150 hermetically seal the grip cavity 150 when the grip plug 200 is in a closed position.

The pull tab 240 extends from a portion of the grip plug body 210. In various exemplary embodiments, the pull tab 240 is positioned so as to extend from a bottom of the grip plug body 210 and provide sufficient area to be grasped by a user's fingers so that a removing force can be applied to the grip plug 200 and the grip plug 200 can be moved to an open position. The pull tab 240 also provides an area where a closing force can be applied so as to move the grip plug 200 to a closed position.

While the pull tab 240 can be positioned at any desired location relative to the grip plug body 210, if that the pull tab 240 is positioned forward of a relative center of the grip plug body 210 (i.e., toward the first end portion 211) a removal force is applied to the grip plug 200 closer to the tab 220 (where the tab 220 is designed to be released from the tab aperture 120), resulting in easier removal or closure of the grip plug 200. If the pull tab 240 is positioned proximate the center of the grip plug 200, a removal force would be applied more equally to the tab 220 and the tether portion 235/locking protrusion.

The overall size, shape, and/or texture of the pull tab 240 is a design choice, based upon the desired appearance and/or desired tactile properties of the pull tab 240.

In certain exemplary embodiments, two or more flex recesses 217 are formed through at least a portion of the skirt 215. The flex recesses 217 may be formed proximate and on either side of the tab 220. The flex recesses 217 generally comprise slots or recesses that allow at least a portion of the skirt 215 or grip plug 200 to be able to flex proximate or within the flex recesses 217, to give greater flexibility to the skirt 215 and/or grip plug body 210.

A tether portion 235 extends from a portion of the skirt 215 or the grip plug body 210, proximate the second end portion 212 of the grip plug body 210. The lock protrusion 230 extends from the tether portion 235. In various exemplary embodiments, the tether portion 235 is sized and shaped so as to extend through the lock protrusion aperture 130. A cross-section of the tether portion 235 generally extends further than a cross-section of the lock protrusion 230, such that the lock protrusion 230 can be positioned through the lock protrusion aperture 130 and expand to secure the lock protrusion 230 on the outside of the lock protrusion aperture 130. A shoulder formed opposite the interior side wall portion 155 proximate the lock protrusion aperture 130 operates to maintain the lock protrusion 230 outside of the lock protrusion aperture 130 and maintain the grip plug 200 in a resiliently captured position, relative to the grip 100. In various exemplary embodiments, the tether portion 235 and lock protrusion 230 form a substantially "T" shaped element, with the upper portion of the "T" shape (the lock protrusion 230) being placed through the lock protrusion aperture 130 and the lower portion of the "T" shape (the tether portion 235) being positioned at least partially within the lock protrusion aperture 130 to retain the grip plug 200 and kept the grip plug 200 from separating from the grip 100.

Because of the resilient nature of the tether portion 235, at least the tether portion 235 is able to flex to allow the grip plug 200 to be repeatably movable between the open position in the closed position.

The tab 220 extends from a portion of the skirt 215 or the grip plug body 210, proximate the first end portion 211 of the grip plug body 210. The tab 220 is formed so as to interact with the tab aperture 120 to maintain the grip plug 200 in a closed position. In various exemplary embodiments, the tab 220 includes a ramped portion 223 and a locking shoulder 225. If included, the ramped portion 223 allows the tab 220 to more easily be positioned within the tab aperture 120, when being moved from an open position to a closed position. Once in the closed position, the locking shoulder 225 interacts with the tab aperture 120 to maintain the tab 220 within the tab aperture 120 until a sufficient removal force is applied to the grip plug 200.

In certain exemplary embodiments, each of the grip plug body 210, the skirt 215, the tab 220, the tether portion 235, the lock protrusion 230, and the pull tab 240 are integrally formed as a single component.

During use of the grip plug 200, to move the grip plug 200 from the open position to the closed position, as a user begins to apply a closing force to the grip plug body 210 or pull tab 240, the grip plug 200 is initially tethered to the grip 100, via interaction of the tether portion 235, the lock protrusion 230, and the lock protrusion aperture. As the grip plug 200 is inserted or rotated into the grip cavity 150 of the grip 100, the grip plug 200 is guided into position by at least some of the interior side wall portions 155 and the grip plug body 210 and/or skirt 215, such that the tab 220 of the grip plug 200 is aligned with the tab aperture 120 of the grip 100.

As the grip plug 200 is inserted further into the grip cavity 150, the surface of the ramped portion 223 is contacted by the surface defining the grip cavity 150 and the tab 220 and/or portion of the skirt 215 and/or grip plug body 210 associated with a tab 220 is/are flexed inwardly to allow the tab 220 to pass along the surface defining the grip cavity 150.

The portions of the grip plug 200 continue to be flexed inwardly until the locking shoulder 225 of the tab 220 passes beyond an edge of the tab aperture 120. When the locking shoulder 225 passes beyond an edge of the tab aperture 120, the resilient bias of the grip plug 200 causes the flexed portion of the tab 220, grip plug 200, and/or skirt 215 to flex or snap outwardly and the tab 220 to be positioned at least partially within the tab aperture 120 and the locking shoulder 225 to interact with a surface of the tab aperture 120 to maintain the tab 220 in a locked position relative to the tab aperture 120. Thus, the grip plug 200 assumes the closed position, as illustrated in FIGS. 1-7 and 20.

When the tab 220 is secured within the tab aperture 120, the grip plug 200 is in a closed position relative to the grip cavity 150 and interaction between the tether portion 235 and the lock protrusion aperture 130 and the tab 220 and tab aperture 120 act against a withdrawing or opening force that would work to urge the tab 220 from the tab aperture 120.

In order to move the grip plug 200 from the closed to the open position, a removal or withdrawing force is applied to the grip plug body 210 or pull tab 240. When a sufficient removal or withdrawing force is applied to the grip plug body 210 or pull tab 240, the resilient bias of the grip plug body 210, skirt 215, and/or tab 220 is over, and the grip plug body 210 flex is sufficient to allow the locking shoulder 225 of the tab 220 to be withdrawn from the tab aperture 120. When the tab 220 is withdrawn from the tab aperture 120, the grip plug 200 can be moved to the open position. In the open position, the tether portion 235 and lock protrusion 230 are flexibly maintained within the lock protrusion aperture 130, so that the grip plug 200 remains attached or coupled to the grip 100.

It is believed that the level of description provided herein is sufficient to enable one of ordinary skill in the art to understand and practice the present disclosure, as described.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A grip, comprising:

a grip body having a grip cavity extending from an open grip cavity bottom end, wherein a lock protrusion aperture is formed proximate said open grip cavity bottom end;

a grip plug body extending from a first end portion to a second end portion;

a skirt extending downward from at least a portion of said grip plug body;

a pull tab extending from a portion of said plug body;

a tether portion extending from said skirt, proximate said second end portion of said grip plug body, wherein a lock protrusion extends from said tether portion, wherein said tether portion is positionable through at least a portion of said lock protrusion aperture; and a tab extending from said skirt, proximate said first end portion of said grip plug body.

2. The grip plug of claim 1, wherein said grip plug body is a substantially oval shape.

3. The grip plug of claim 1, wherein two or more flex recesses are formed through at least a portion of said skirt, wherein each flex recess is formed proximate said tab.

4. The grip plug of claim 1, wherein said lock protrusion is a T-shaped lock protrusion.

5. The grip plug of claim 1, wherein said grip plug is formed of a substantially resilient material.

6. The grip plug of claim 1, wherein each of said grip plug body, said skirt, said tab, said tether portion, said lock protrusion, and said pull tab are integrally formed as a single component.

7. A grip and grip plug, said grip comprising:

a grip body having a grip cavity extending from an open grip cavity bottom end to a grip cavity top wall portion;

a tab aperture formed proximate said grip cavity bottom end;

a lock protrusion aperture formed proximate said grip cavity bottom end;

said grip plug, comprising:

a grip plug body extending from a first end portion to a second end portion;

a skirt extending from at least a portion of said grip plug body;

a pull tab extending from a portion of said plug body;

a tether portion extending from said skirt, proximate said second end portion of said grip plug body, wherein a lock protrusion extends from said tether portion, wherein said tether portion is positionable through at least a portion of said lock protrusion aperture, and wherein said lock protrusion extends beyond at least a portion of said lock protrusion aperture; and a tab extending from said skirt, proximate said first end portion of said grip plug body, wherein said tab is removably engageable with at least a portion of said tab aperture, such that when said tab is engaged within at least a portion of said tab aperture, said grip plug is positioned within at least a portion of said open grip cavity bottom end.

8. The grip plug of claim 7, wherein said grip plug body is a substantially oval shape.

9. The grip plug of claim 7, wherein two or more flex recesses are formed through at least a portion of said skirt, wherein each flex recess is formed proximate said tab.

10. The grip plug of claim 7, wherein said lock protrusion is a T-shaped lock protrusion.

11. The grip plug of claim 7, wherein said grip plug is formed of a substantially resilient material.

12. The grip plug of claim 7, wherein each of said grip plug body, said skirt, said tab, said tether portion, said lock protrusion, and said pull tab are integrally formed as a single component.

13. The grip plug of claim 7, wherein when said grip plug is positioned within at least a portion of said open grip cavity bottom end, frictional engagement between at least a portion of said grip plug and interior side walls forming said grip cavity hermetically seal said grip cavity.

14. A grip having a grip plug, comprising:

a grip body having a grip cavity that extends from an open grip cavity bottom end to a grip cavity top wall portion;

a tab aperture formed proximate said grip cavity bottom end;

a lock protrusion aperture formed proximate said grip cavity bottom end;

said grip plug having a grip plug body;

a skirt that extends from at least a portion of said grip plug body;

a tether portion that extends from said skirt, wherein a lock protrusion extends from said tether portion, wherein said tether portion is positionable through at least a portion of said lock protrusion aperture, and wherein said lock protrusion extends beyond at least a portion of said lock protrusion aperture; and a tab that extends from said skirt, wherein said tab is removably engageable with at least a portion of said tab aperture, such that when said tab is engaged within at least a portion of said tab aperture, said grip plug is positioned within at least a portion of said open grip cavity bottom end.

15. The grip plug of claim 14, wherein said grip plug body is a substantially oval shape.

16. The grip plug of claim 14, wherein two or more flex recesses are formed through at least a portion of said skirt, wherein each flex recess is formed proximate said tab.

17. The grip plug of claim 14, wherein said lock protrusion is a T-shaped lock protrusion.

18. The grip plug of claim 14, wherein said grip plug is formed of a substantially resilient material.

19. The grip plug of claim 14, wherein a pull tab extends from a portion of said plug body.

20. The grip plug of claim 14, wherein when said grip plug is positioned within at least a portion of said open grip cavity bottom end, frictional engagement between at least a portion of said grip plug and interior side walls forming said grip cavity hermetically seal said grip cavity.

* * * * *